US011399576B2

(12) United States Patent
Suffolk

(10) Patent No.: US 11,399,576 B2
(45) Date of Patent: Aug. 2, 2022

(54) GUSSETLESS DANCE TIGHT

(71) Applicant: Drew Layne, LLC, Lewisville, TX (US)

(72) Inventor: Keri Suffolk, Oak Point, TX (US)

(73) Assignee: DREW LAYNE, LLC, Lewisville, TX (US)

( * ) Notice: Subject to any disclaimer, the term of this patent is extended or adjusted under 35 U.S.C. 154(b) by 344 days.

(21) Appl. No.: 16/292,781

(22) Filed: Mar. 5, 2019

(65) Prior Publication Data

US 2020/0281280 A1 Sep. 10, 2020

(51) Int. Cl.

| | |
|---|---|
| ***A41B 11/00*** | (2006.01) |
| ***A41B 11/14*** | (2006.01) |
| ***A41H 43/00*** | (2006.01) |

(52) U.S. Cl.

CPC ..... *A41B 11/003* (2013.01); *A41B 11/14* (2013.01); *A41H 43/00* (2013.01); *A41B 2500/10* (2013.01)

(58) Field of Classification Search

CPC ..... A41B 9/004; A41B 11/06; A41B 11/08; A41B 11/003; A41B 11/14; A41B 2500/10

See application file for complete search history.

(56) References Cited

U.S. PATENT DOCUMENTS

| | | | | |
|---|---|---|---|---|
| 3,946,579 | A * | 3/1976 | Heinig | A41B 9/004 66/177 |
| 6,047,571 | A * | 4/2000 | Juniman | A41B 11/14 66/178 A |
| 7,931,639 | B2 * | 4/2011 | Suga | A61F 13/72 604/396 |
| 8,661,568 | B1 | 3/2014 | O'Brien | |
| 2012/0036616 | A1 | 2/2012 | Miyasaka | |

FOREIGN PATENT DOCUMENTS

JP 2005120550 A * 5/2005

OTHER PUBLICATIONS https://patents.google.com/patent/JP2005120550A/en?oq=jp2005120550 (Year: 2005).*
Homepage, "http://heist-studios.com", retrieved 2019.

* cited by examiner

*Primary Examiner* — Sally Haden

(57) ABSTRACT

A gussetless dance tight is disclosed. The gussetless dance tight comprises a legwear portion created from a single tube without any vertical seams. The legwear portion comprises an upper portion, two leg portions, and a transition between the two leg portions where the two leg portions meet. The legwear portion comprises a higher density area at the transition. The higher density area transitions to the upper portion using circular knitting without a gather stitch. The gussetless dance tight also comprises a waistband coupled to the upper portion.

20 Claims, 8 Drawing Sheets

GUSSETLESS DANCE TIGHT

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Dancers often wear tights while dancing. Tights allow the entire leg line to be seen and cover areas the dancer wants to keep concealed when certain dance garments such as tutus are worn. The tights also help absorb sweat from the dancer's legs and may prevent some abrasions to the dancer's legs when in contact with the floor.

SUMMARY

In an embodiment, a gussetless dance tight is disclosed. The gussetless dance tight comprises a legwear portion created from a single tube without any vertical seams. The legwear portion comprises an upper portion, two leg portions, and a transition between the two leg portions where the two leg portions meet. The legwear portion comprises a higher density area at the crotch portion. The higher density area transitions to the upper portion using circular knitting without a gather stitch. The gussetless dance tight also comprises a waistband coupled to the upper portion.

In another embodiment, a gussetless dance tight is disclosed. The gussetless dance tight comprises a legwear portion created from a single tube without any vertical seams. The legwear portion comprises an upper portion, two leg portions, and a transition between the two leg portions where the two leg portions meet. The legwear portion comprises a higher density area at the transition. The higher density area comprises a highest density area that at least encompasses a center point of the transition. The highest density area has a highest density of the higher density area. The gussetless dance tight also comprises a waistband coupled to the upper portion.

In yet another embodiment, a method of making a gussetless dance tight is disclosed. The method comprises circular knitting a legwear portion using a single tube. The legwear portion comprises an upper portion, a first leg portion, a second leg portion, and a transition where the first and second leg portions meet. Circular knitting the legwear portion comprises creating a higher density area at the transition by circular knitting at one or more higher densities around a part of the circumference of the single tube without use of a gather stitch where the higher density area meets the upper portion. The method also comprises positioning the first leg portion parallel to the second leg portion and cutting horizontally across the upper portion. The method further comprises circular knitting a waistband using at least one tube and sewing the upper portion to the waistband.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Figure 1A:
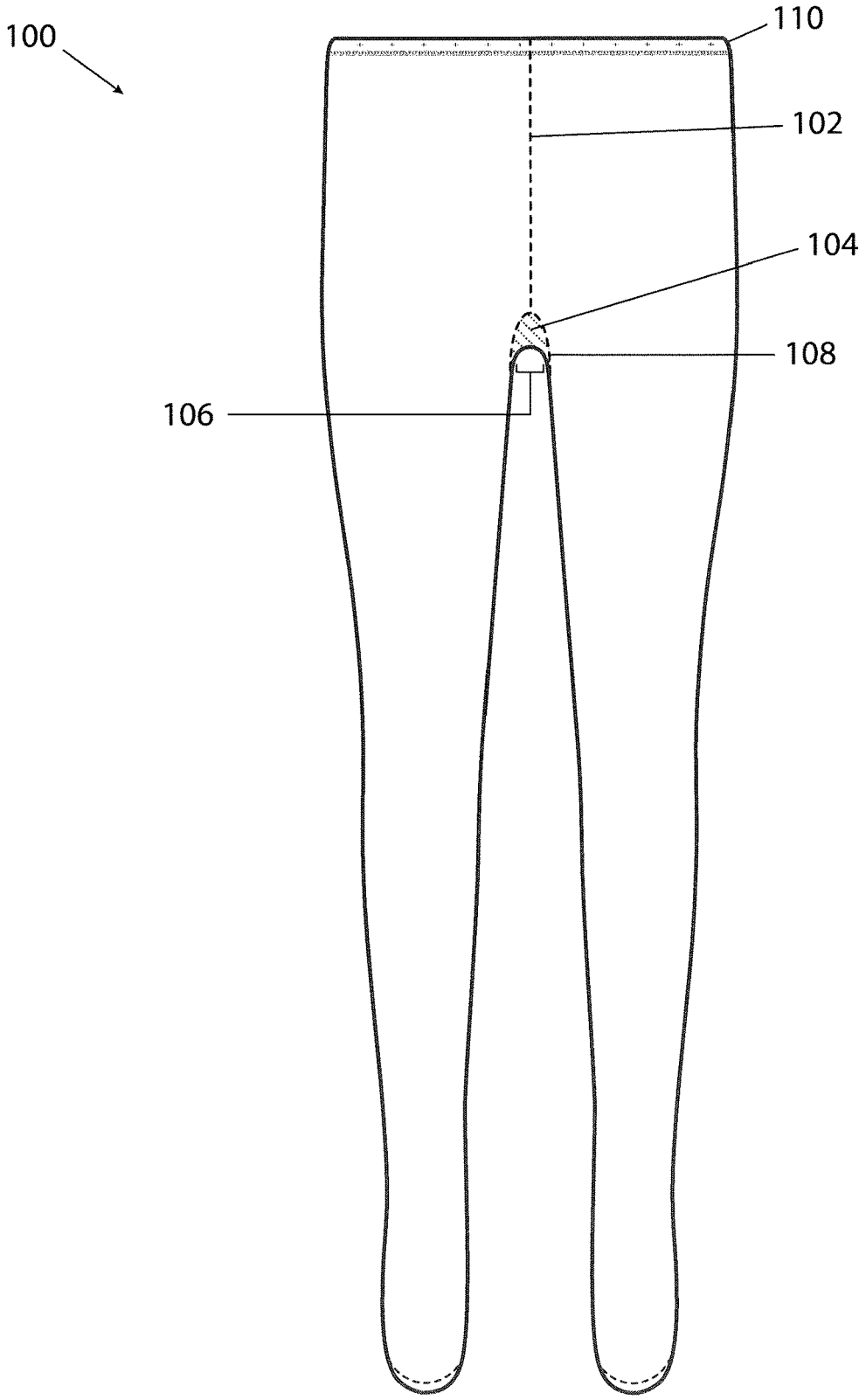
FIG. 1A Prior Art
FIG. 1A is a front view of a traditional dance tight.
Figure 1B:
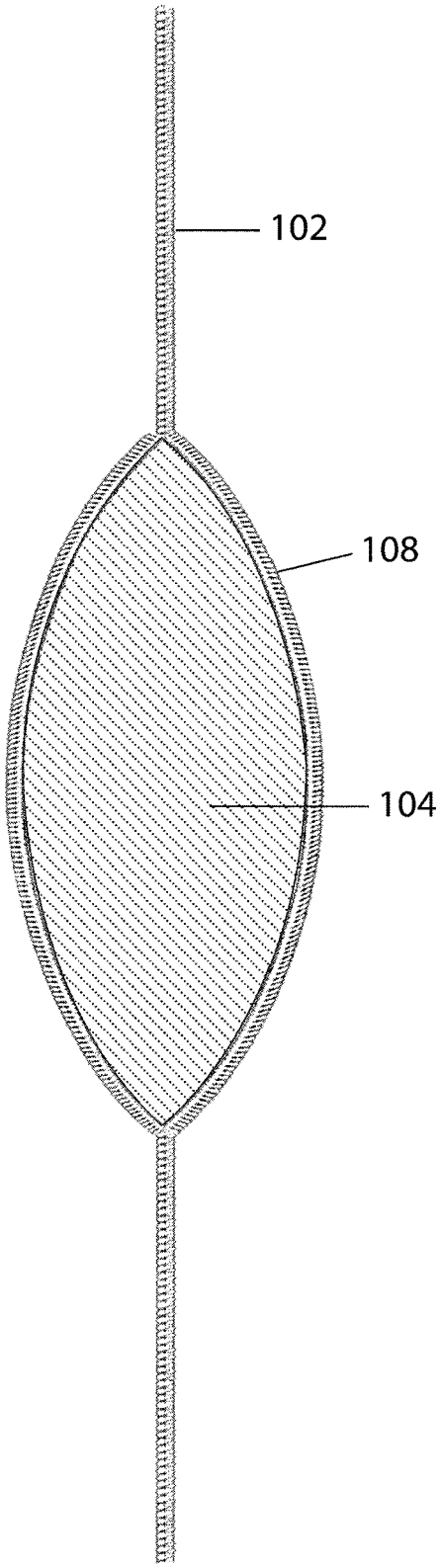
FIG. 1B Prior Art
FIG. 1B is bottom view illustrating a gusset of the traditional dance tight.

FIGS. 1A and 1B illustrate a traditional dance tight 100. The traditional dance tight 100 is created by a complex process. A circular threading machine is used to create the main body of the tight 100 by making a tubular sleeve of material. Once the tubular sleeve is finished, it is sucked out of the circular knitting machine by a vacuum hose and deposited elsewhere for inspection. Next, the two legs are positioned on a different machine (a leg mold) to join them together. The leg mold machine presses them together and makes a cut at the top of the pair of legs. The cut is perpendicular to the length of the tube. As the machine revolves, the cut is enlarged such that it can be sewn later. This is what creates the distinctive vertical seam 102 down the middle of the traditional dance tight 100.

Next, a gusset 104 is made. A gusset 104 is a separate piece of fabric sewn into a tight to add breadth at the crotch seam. To add the gusset 104, the newly sewn garment must be re-cut at a transition 106 between the two legs or the crotch of the traditional dance tight 100. The tight 100 is vacuumed again onto another mold and ends up inside out such that the stitching ends up on the inside of the tight 100.

At this point in the process, the tubes that will become legs are still open at the bottom and need to be sewn at the toes. The toes are sewn straight across and a cutting machine trims off any excess fabric. Next, the gusset 104 is finished by taking the tight 100 to a different machine where a human operator installs the gusset 104 with the help of the different machine. The open gusset area is folded over a circular mold. A pre-cut disc is slipped underneath the circular mold and pressed up to the tight 100 and held in place while a small mechanical arm stitches the gusset 104 in place. To finish the traditional dance tight 100, the extra material is trimmed and a dye process is commenced.

Dancers place a number of stresses on the transition 106 between the two legs of the tight 100 with their movements. A traditional dance tight 100 addresses these stresses via the gusset 104. Since the gusset 104 is sewn into the tight 100, a gusset seam 108 exists in the traditional dance tight 100. The vertical seam 102 and the gusset 104/gusset seam 108 of the traditional dance tight 100 are uncomfortable for the dancer and show when worn under leotards and costumes.

The traditional dance tight 100 also comprises a narrow waistband 110. The narrow waistband 110 is typically about an inch or less in height. The narrow waistband 110 has a tendency to dig into and roll down on the dancer, thereby frustrating the dancer and again making the traditional dance tight 100 uncomfortable.

Figure 2A:
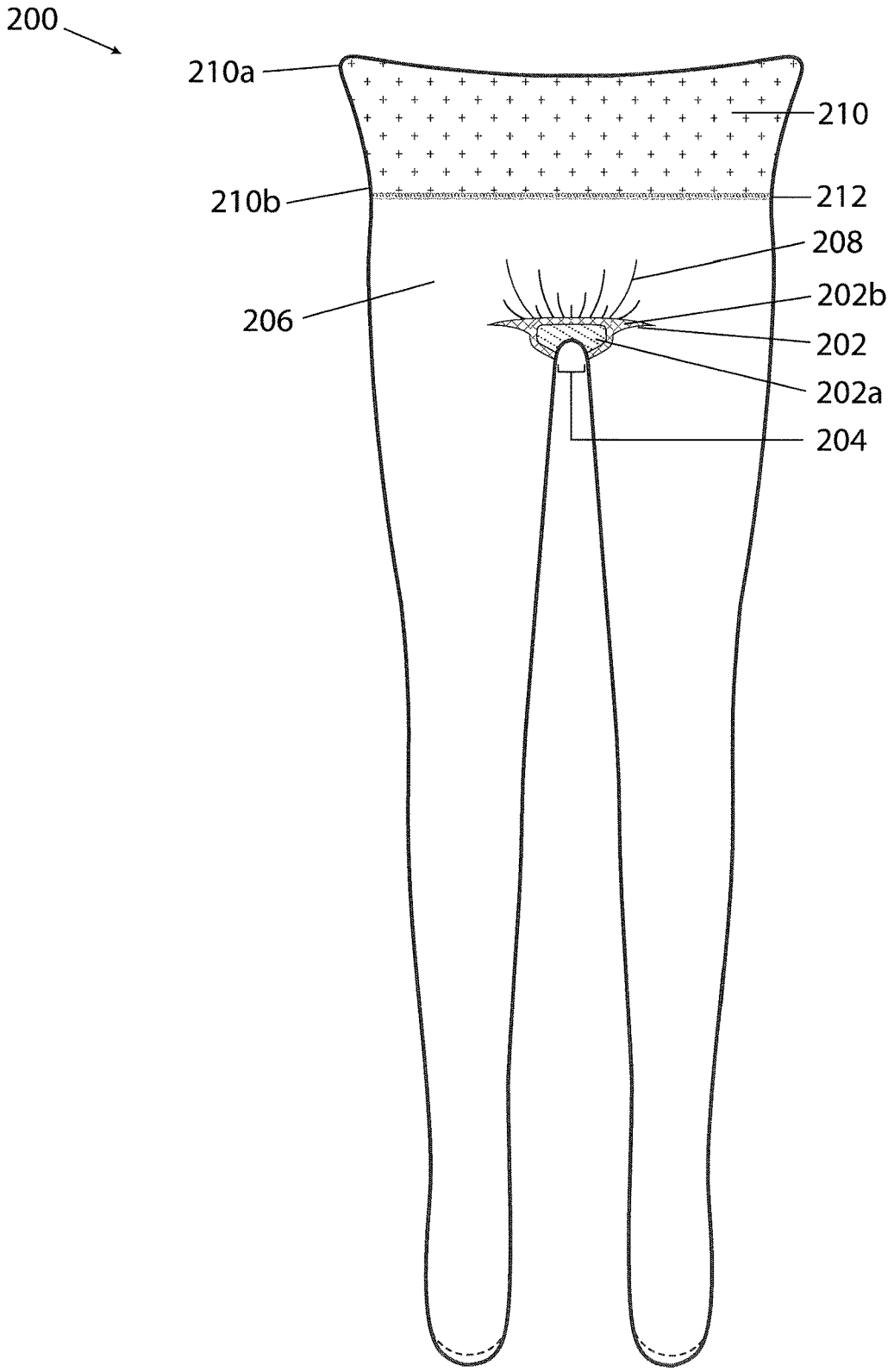
FIG. 2A Prior Art
FIG. 2A is a front view of a prior art tight.
Figure 2B:
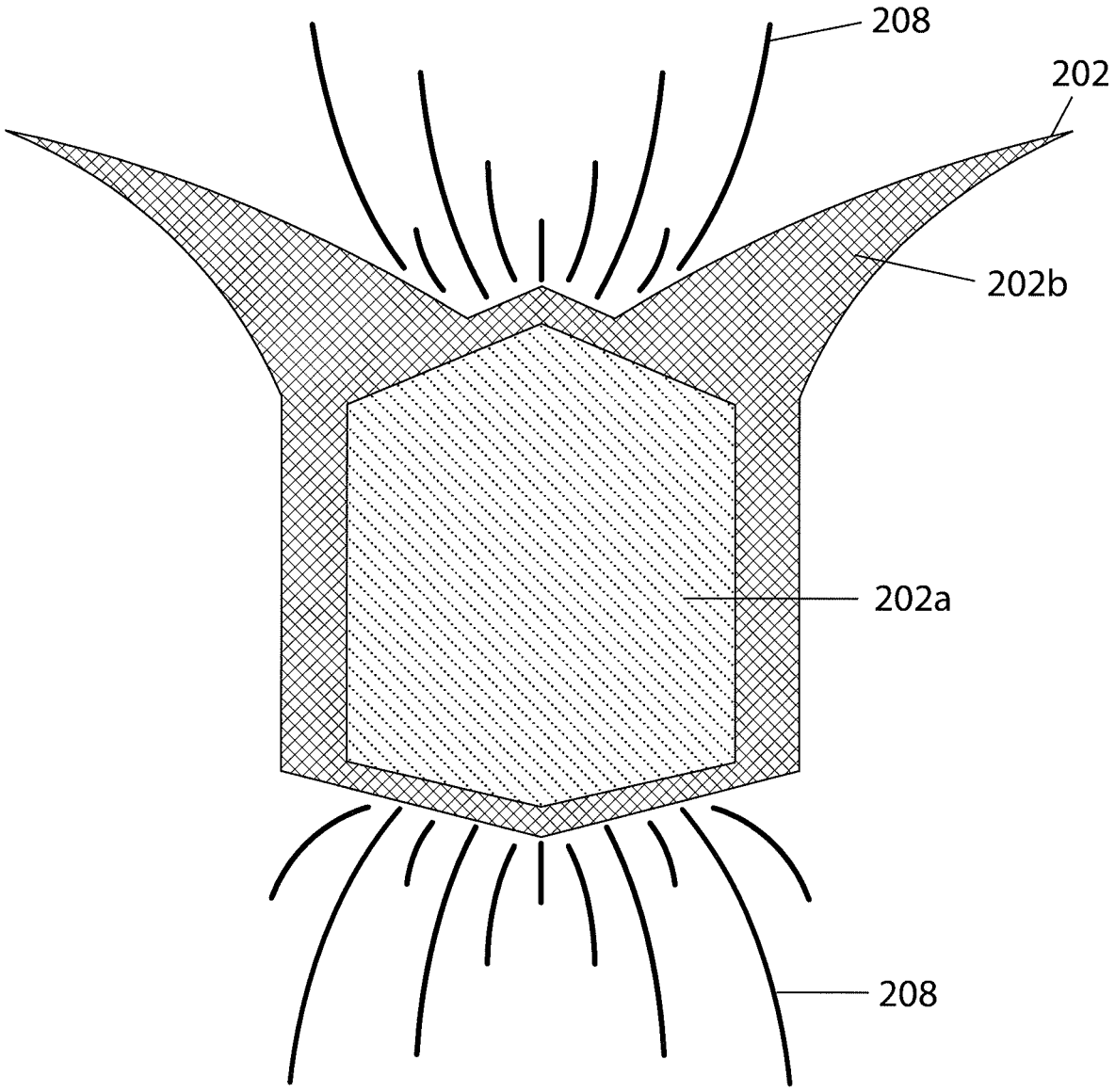
FIG. 2B Prior Art
FIG. 2B is a bottom view of a crotch area of the prior art tight.

FIGS. 2A and 2B illustrate a tight 200 without a gusset. The tight 200 comprises a higher density area 202 around a transition 204 between the legs or the crotch area. The higher density area 202 comprises an interior area 202*a* that is less dense than an outer perimeter 202*b* of the higher density area 202. The higher density area 202 is greater than three inches in width. For example, in a US size 10-12, the higher density area 202 is 3.5 inches in width. As such, the higher density area 202 is not contained to the crotch area and extends below a leg line onto a leg of the wearer such that the higher density area 202 would be visible under leotards and costumes.

The outer perimeter 202*b* of the higher density area 202 is joined to an upper portion 206 using a gather stitch. A gather stitch draws stitches closer together laterally. The gather stitch creates a gathered or ruched effect 208 at the front and back of the tight 200 where the outer perimeter 202*b* of the higher density area 202 joins the upper portion 206 of the tight 200. The gathered or ruched effect 208 of the tight 200 caused by the gather stitch would also be visible under leotards and costumes if a dancer were to wear tight 200.

The tight 200 also comprises a waistband 210. The waistband 210 is coupled to the upper portion 206 via seam 212. The length of the waistband 210 at a top 210*a* of the waistband 210 is greater than the length of the waistband 210 at a bottom 210*b* of the waistband 210. For example, in a US size 10-12, the length of the waistband 210 at the top 210*a* is eleven inches and the length of the waistband 210 at the bottom 210*b* is 9.5 inches. Having a greater length at the top 210*a* of the waistband than the bottom 210*b* of the waistband results in less stomach support and control as well as leading to the tight 200 falling down if a dancer were to wear and dance in tight 200. The height of the waistband 210 of tight 200 is greater than the height of waistbands in traditional dance tights.

The present disclosure is directed to an improved gussetless tight. As discussed above, gussets are uncomfortable for dancers and show under leotards and costumes. However, removing a gusset from a tight, especially a dance tight, creates challenges. In particular, as a dancer moves (e.g., kicks, jumps, etc.), a tight without a gusset has an increased likelihood to tear, rip, or inelastically deform at the transition between the two legs opposite the waistband. To address the stresses put on this transition, the dance tight disclosed herein comprises a higher density area at the transition instead of a gusset. The higher density area has a higher density than the leg and upper portions of the dance tight.

The width of the higher density area is of a size that will not protrude from a leotard or costume worn over the dance tight. For example, the higher density area may be less than two inches in width and be generally oval in shape. The higher density area may meet with an upper portion of the dance tight using circular knitting without a gather stitch, thereby creating a smooth knitting effect with no discernible gathers or ruches. The smooth knitting effect created without a gather stitch ensures that the dance tight lays flat underneath a leotard and costume.

The higher density area of the dance tight disclosed herein may comprise varying higher densities. In an embodiment, the higher density area comprises its highest density at the center of the crotch area. The higher density area may increase in density from both directions along an axis where the two leg portions transition together towards the center of the crotch area to allow for a smoother, more gradual transition between the upper portion of the dance tight and the higher density area.

The disclosed gussetless dance tight also comprises a waistband. The height of the waistband is thicker than traditional dance tights, thereby providing greater stomach support and control and increasing the likelihood that the dance tight remains in place while the dancer dances. Further, in an embodiment, the length of the top of the waistband is approximately equivalent to the length of the bottom of the waistband, which also enables greater stomach support and control and improves the effectiveness of that the dance tight staying put while the dancer dances.

In contrast to how traditional dance tights are made, the dance tight disclosed herein, which does not comprise a gusset, is constructed via a more sophisticated process that requires less steps. For example, the main body of the gussetless dance tight is circular knitted using a single tube via circular knitting machine. As part of this process, to address the stresses placed at the transition between the two legs, the circular knitting machine creates a higher density area at the transition by circular knitting at one or more higher densities around a part of the circumference of the single tube without use of a gather stitch where the higher density area transitions to the upper portion of gussetless dance tight. Next, a first leg is placed parallel to a second leg and the upper portion is cut generally parallel to the tube. Since the upper portion is cut horizontally rather than vertically as with the traditional dance tight 100, the dance tight disclosed herein does not disclose a vertical seam in the upper portion of the dance tight.

Next, the waistband is created by circular knitting using at least one tube and then sewn onto the upper portion. In some embodiments, the disclosed dance tight may be a convertible dance tight and an opening may be created on the bottom of the foot portions of the first and second legs, thereby allowing a dancer to quickly and easily remove their feet to, for example, adjust pointe shoe pads or put on another pair of shoes.

The improved, integral knitting approached used to address the stresses placed on the transition between the legs via the creation of the higher density area reduces the number of seams on the gussetless dance tight. Additionally, a smaller area is able to be created at the transition to handle the stresses placed on the crotch area through the use of the improved manufacturing process disclosed herein. Further, the improved manufacturing technique disclosed herein for the gussetless tight reduces costs at least in the handling of the transition between the legs. For example, the transition between the legs in the gussetless dance tight disclosed herein is addressed via the creation of the higher density area by the circular knitting machine. In contrast, with traditional dance tight 100, the transition between the legs is addressed via installation of a gusset which involves moving the traditional dance tight 100 to and using multiple machines after the main body is created via the circular knitting machine.

The reduced seams and smaller, higher density area at the transition between the legs enabled via the manufacturing process disclosed herein results in an improved look over the traditional dance tight 100. For example, there is no center, vertical seam on the upper portion or gusset seams that are visible under leotards and costumes. Instead, the smaller, higher density area at the transition between the legs is concealed under leotards and costumes. Further, the wider waistband of the gussetless dance tight disclosed herein is more comfortable and stable and provides more stomach control than the thinner waistband of the traditional dance tight 100.

Figure 3A:
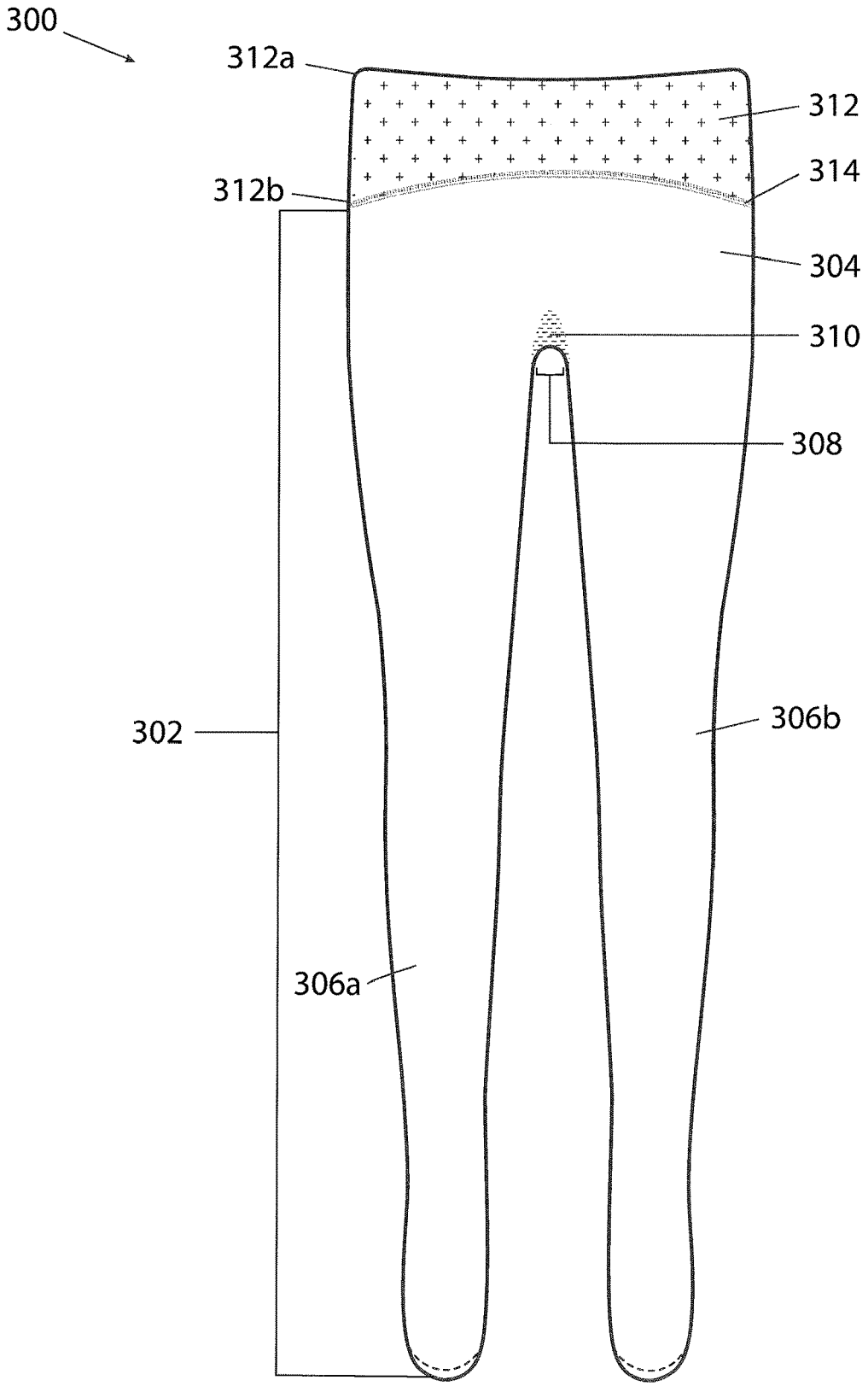
FIG. 3A is front view of a gussetless dance tight according to an embodiment of the disclosure.
Figure 3B:
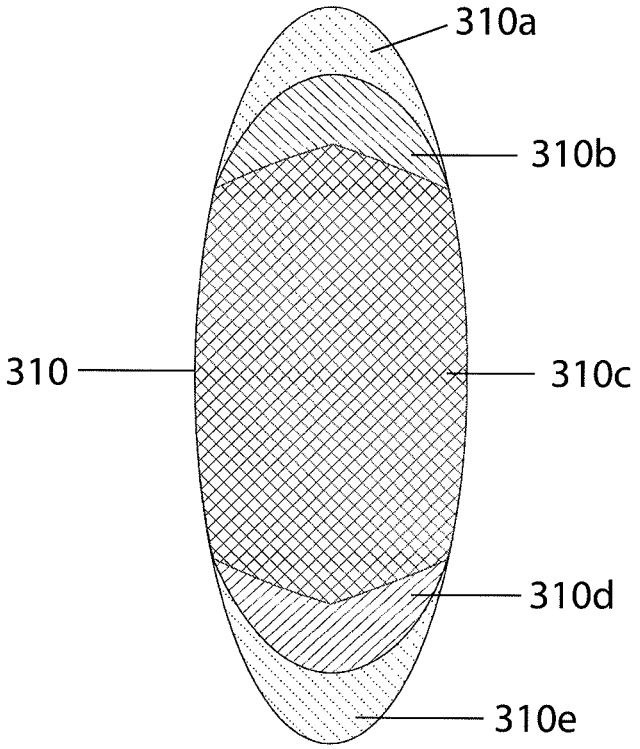
FIG. 3B is a bottom view of a crotch area of a gussetless dance tight according to an embodiment of the disclosure.

Turning now to FIGS. 3A and 3B, a gussetless dance tight 300 is disclosed. The dance tight 300 does not comprise a gusset. In an embodiment, the dance tight 300 comprises a legwear portion 302 created from a single tube without any vertical seams. The legwear portion 302 may comprise an upper portion 304, two leg portions 306*a*, 306*b*, and a transition 308 between the two leg portions 306*a*, 306*b*. The transition 308 is where the two leg portions 306*a*, 306*b* opposite a waistband 312.

As discussed above, gussets are uncomfortable for dancers and show under leotards and costumes. However, removing a gusset from a tight, especially a dance tight, creates challenges. In particular, as a dancer moves (e.g., kicks, jumps, etc.), a tight without a gusset has an increased likelihood to tear, rip, or inelastically deform at the transition 308. Thus, the gussetless dance tight 300 disclosed herein may comprise a higher density area 310 at the transition 308. The higher density area 310 has a higher density than leg portions 306*a*, 306*b* and upper portion 304 of the dance tight 300.

The width of the higher density area 310 is of a size that will not protrude from a leotard or costume worn over the dance tight 300. For example, the higher density area 310 may be less than two inches in width, but greater than zero. In an embodiment, the width of the higher density area is between 0.25 inches and 1.5 inches. The length of the higher density area 310 may between two inches and four inches. In an embodiment, the higher density area 310 is generally oval in shape. In alternative embodiments, the higher density area 310 may be generally rectangular in shape, triangular in shape, or a different shape.

The higher density area 310 may meet with an upper portion 304 of the dance tight 300 using circular knitting without a gather stitch, thereby creating a smooth knitting effect with no discernible gathers or ruches. The smooth knitting effect created without a gather stitch helps ensure that the dance tight 300 lays flat underneath a leotard and costume.

The higher density area 310 of the dance tight 300 may comprise varying higher densities. In an embodiment, the higher density area 310 comprises its highest density at the center of the transition 308. The higher density area 310 may increase in density from both directions along an axis where the two leg portions 306*a*, 306*b* meet together towards the center of the transition 308 to allow for a smoother, more gradual transition between the upper portion 304 of the dance tight 300 and the higher density area 310. For example, referring to FIG. 3B, starting toward the back of the transition 308 and moving toward the front of the transition 308, the higher density area 310 may comprise a first area 310*a* having a first density, a second area 310*b* having a second density, a third area 310*c* having a third density, a fourth area 310*d* having the second density, and a fifth area 310*e* having the first density. In an embodiment, the densities may increase towards the middle where the first density is less than the second density and the second density is less than the third density. In an alternative embodiment, the densities may decrease towards the middle where the first density is more than the second density and the second density is more than the third density.

While three different densities are illustrated in FIG. 3B, the higher density area 310 may comprise more or less densities without departing from the spirt or scope of the present disclosure. For example, the higher density area 310 may comprise a single density, two densities, four densities, or another number of densities. Also, while five different areas are shown in FIG. 3B as part of the higher density area 310, the higher density area 310 may comprise more or less different areas without departing from the spirt or scope of the present disclosure. For example, the higher density area 310 may comprise a single area, two areas, three areas, four areas, six areas, seven areas, or another number of areas.

In an embodiment, the gussetless dance tight 300 also comprises a waistband 312. The waistband 312 may be created from a single tube. Creation of the waistband 312 from a single tube prevents vertical seams on the waistband 312. The waistband 312 can alternatively be created from more than one tube. The waistband 312 may be sewn to the upper portion 304 using a flat seam to minimize the appearance of seam 314 underneath leotards and costumes. For example, the seam 314 may be a flat interlock seam.

The height of the waistband 312 is thicker than traditional dance tights, thereby providing greater stomach support and control and helping to ensure that the dance tight 300 remains in place while the dancer dances. For example, the height of the waistband 312 may be between two and 3.5 inches. In an embodiment, the waistband 312 is generally the same shape as a tutu basque such that the waistband 312 is not visible when worn underneath a tutu.

The length of a top 312*a* of the waistband 312 may be approximately equivalent to the length of a bottom 312*b* of the waistband 312. For example, the top 312*a* of the waistband 312 and the bottom 312*b* of the waistband 312 may vary by less than a quarter of an inch. Depending on the size of the dance tight 300, the length of the top 312*a* and the bottom 312*b* of the waistband 312 may be between 6 and 8.5 inches. Having the length of the top 312*a* and bottom 312*b* of the waistband 312 approximately equivalent also enables greater stomach support and control and increase the likelihood that the dance tight 300 will stay put while the dancer dances. The waistband 312 may comprise fabric folded over and sewn together at the seam 314 to create a double fabric construction and provide even stronger stomach support and control and help minimize movement of the dance tight 300 on the dancer.

The gussetless dance tight 300 may be footed as illustrated in FIG. 3*a*. A footed dance tight completely covers the dancer's feet with no openings. The gussetless dance tight 300 may alternatively be convertible, footless, or comprise stirrups without departing from the spirt or scope of the present disclosure.

The gussetless dance tight 300 may be created by circular knitting. The fibers used in the circular knitting may comprise nylon, spandex, cotton, silk, or another material. The thickness of the fibers used to create the gussetless dance tight 300 may range from 40 denier to 80 denier. In a preferred embodiment, the gussetless dance tight 300 is created using fibers measuring 70 denier. Softener and aloe may be added to the gussetless dance tight 300 to create softness.

Figure 4:
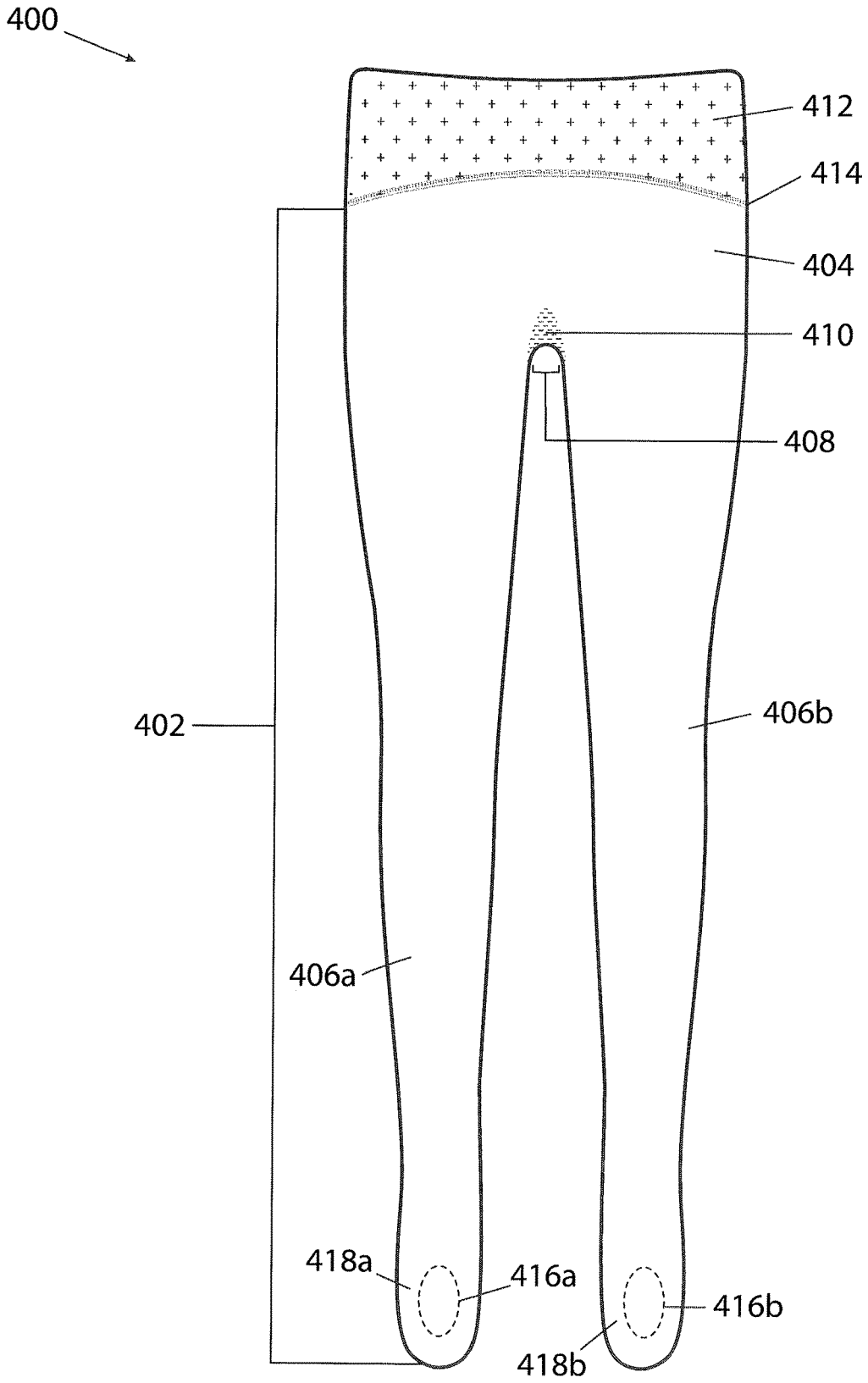
FIG. 4 is a front view of a gussetless dance tight according to an embodiment of the disclosure.

Turning now to FIG. 4, a gussetless dance tight 400 is disclosed. The gussetless dance tight 400 is substantially similar to the gussetless dance tight 300 except that dance tight 400 comprises convertible feet. For example, in an embodiment, dance tight 400 comprises a legwear portion 402 including an upper portion 404, two leg portions 406*a*, 406*b*, and a transition 408 between the two leg portions 406*a*, 406*b*, a higher density area 410 at the crotch portion 408, a waistband 412, and a seam 414. In contrast to dance tight 300, dance tight 400 also comprises openings 416*a*, 416*b* on each foot portion 418*a*, 418*b* of the leg portions 406*a*, 406*b*. The openings 416*a*, 416*b* may be positioned under a foot when the gussetless dance tight 400 is worn. The openings 416*a*, 416*b* may allow a dancer to quickly and easily remove their feet to, for example, adjust pointe shoe pads or put on another pair of shoes.

Figure 5:
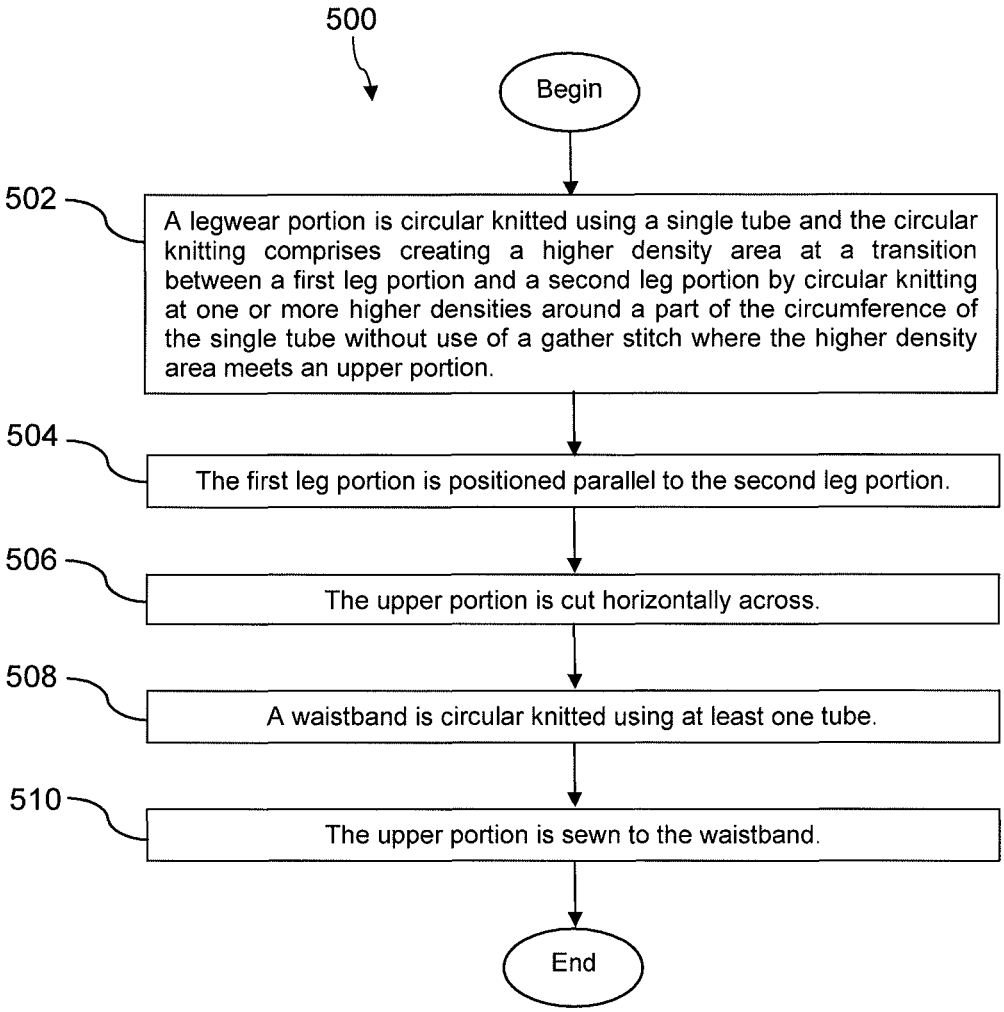
FIG. 5 is a flowchart of a method according to an embodiment of the disclosure.

Turning now to FIG. 5, a method 500 of making a gussetless dance tight is disclosed. At block 502, a legwear portion is circular knitted using a single tube. The legwear portion comprising an upper portion, a first leg portion, a second leg portion, and a transition where the first and second leg portions meet. Circular knitting the legwear portion comprises creating a higher density area at the transition by circular knitting at one or more higher densities around a part of the circumference of the single tube without use of a gather stitch where the higher density area meets the upper portion. At block 504, the first leg portion is positioned parallel to the second leg portion. At block 506, the upper portion is cut horizontally across. Horizontally across may be defined as generally parallel to the tube. At block 508, a waistband is circular knitted using at least one tube. At block 510, the upper portion is sewn to the waistband. Other techniques that one of ordinary skill in the art would understand may be used to create the gussetless tights 300, 400.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A gussetless dance tight, comprising:

a legwear portion created from a single tube without any vertical seams, the legwear portion comprising an upper portion, two leg portions that are each adapted to cover a leg of a wearer in its entirety, and a transition between the two leg portions where the two leg portions meet, wherein the legwear portion comprises a higher density area at the transition, wherein the higher density area is adapted to be contained to a crotch area without extending onto the leg of the wearer, wherein the higher density area comprises a first higher density area that at least encompasses a center point of the transition, two second higher density areas, and two third higher density areas along an axis where the two leg portions meet together, wherein the first higher density area is denser than the second higher density areas, and the second higher density areas are denser than the third higher density areas such that the higher density area increases in density along the axis where the two leg portions meet together towards the center point, wherein each of the first higher density area, the second higher density areas, and the third higher density areas are defined by lateral boundaries at which the density transitions to a lower density, wherein a width of the higher density area starting at the center point decreases along the axis where the two leg portions meet together moving away from the center point such that a width of the lateral boundaries of the first higher density area is greater than a widest width of the lateral boundaries of the second higher density areas and a widest width of the lateral boundaries of the third higher density areas, and wherein the higher density area transitions to the upper portion using circular knitting without a gather stitch; and a waistband coupled to the upper portion.

2. The gussetless dance tight of claim 1, wherein the higher density area at the transition has a width greater than zero and less than two inches.

3. The gussetless dance tight of claim 2, wherein the width of the higher density area is between 0.25 inches and 1.5 inches.

4. The gussetless dance tight of claim 1, wherein each of the leg portions comprise a foot portion at a bottom of the leg portions opposite the upper portion, wherein the foot portion comprises an opening, and wherein the opening is positioned under a foot when the gussetless dance tight is worn.

5. The gussetless dance tight of claim 1, wherein a length of the waistband at a top of the waistband is approximately equivalent to a length of the waistband at a bottom of the waistband.

6. The gussetless dance tight of claim 1, wherein the waistband is created using a single tube.

7. The gussetless dance tight of claim 1, wherein a height of the waistband is between 2 and 3.5 inches.

8. The gussetless dance tight of claim 1, wherein the higher density area is oval in shape.

9. The gussetless dance tight of claim 1, wherein the higher density area comprises a width, and wherein the width is of a size that will not protrude from a leotard worn over the gussetless dance tight.

10. The gussetless dance tight of claim 1, wherein the higher density area comprises more than three different densities.

11. The gussetless dance tight of claim 1, wherein each end of the second higher density areas farthest from the center point comprises tapering widths, and wherein each end of the second higher density areas farthest from the center point comprises tapering widths.

12. A gussetless dance tight, comprising:

a legwear portion created from a single tube without any vertical seams, the legwear portion comprising an upper portion, two leg portions that are each adapted to cover a leg of a wearer in its entirety, and a transition where the two leg portions meet, wherein the legwear portion comprises a higher density area at the transition, wherein the higher density area is adapted to be contained to a crotch area without extending onto the leg of the wearer;

wherein the higher density area comprises a first higher density area that at least encompasses a center point of the transition, two second higher density areas, and two third higher density areas along an axis where the two leg portions meet together, wherein the first higher density area is denser than the second higher density areas, and the second higher density areas are denser than the third higher density areas such that the higher density area increases in density along the axis where the two leg portions meet together towards the center point, wherein each of the first higher density area, the second higher density areas, and the third higher density areas are defined by lateral boundaries at which the density transitions to a lower density, and wherein a width of the higher density area starting at the center point decreases along the axis where the two leg portions meet together moving away from the center point such that a width of the lateral boundaries of the first higher density area is greater than a widest width of the lateral boundaries of the second higher density areas and a widest width of the lateral boundaries of the third higher density areas; and a waistband coupled to the upper portion.

13. The gussetless dance tight of claim 12, wherein the higher density area is oval in shape.

14. The gussetless dance tight of claim 12, wherein the higher density area comprises a width, and wherein the width is of a size that will not protrude from a leotard worn over the gussetless dance tight.

15. The gussetless dance tight of claim 12, wherein a length of the waistband at a top of the waistband is approximately equivalent to a length of the waistband at a bottom of the waistband.

16. The gussetless dance tight of claim 12, wherein each of the leg portions comprise a foot portion at a bottom of the leg portions opposite the upper portion, wherein the foot portion comprises an opening, and wherein the opening is positioned under a foot when the gussetless dance tight is worn.

17. The gussetless dance tight of claim 12, wherein a height of the waistband is between 2 and 3.5 inches.

18. The gussetless dance tight of claim 12, wherein a width of the higher density area at the transition is between 0.25 inches and 1.5 inches.

19. The gussetless dance tight of claim 12, wherein the waistband is created using a single tube.

20. The gussetless dance tight of claim 12, wherein the higher density area comprises more than three different densities.

* * * * *